US005264760A

United States Patent [19]

Genz et al.

[11] Patent Number: 5,264,760

[45] Date of Patent: Nov. 23, 1993

[54] HIGH-PRESSURE METAL HALIDE DISCHARGE LAMP WITH A FILL CONTAINING NICKEL HALIDE

[75] Inventors: Andreas Genz, Berlin; Walter Kiele, Munich, both of Fed. Rep. of Germany

[73] Assignee: Patent-Treuhand-Gesellschaft Für Elektrische Gluehlampen MBH, Munich, Fed. Rep. of Germany

[21] Appl. No.: 732,061

[22] Filed: Jul. 18, 1991

[30] Foreign Application Priority Data

Sep. 24, 1990 [DE] Fed. Rep. of Germany ..... 4030202

[51] Int. Cl.[5] ..... H01J 61/20

[52] U.S. Cl. ..... 313/641; 313/640

[58] Field of Search ..... 313/640, 641

[56] References Cited

U.S. PATENT DOCUMENTS

| | | | |
|---|---|---|---|
| 3,566,178 | 2/1971 | Mori | 313/641 |
| 3,654,506 | 4/1972 | Kuhl et al. | 313/639 |
| 4,243,906 | 1/1981 | Wilson | 313/640 X |
| 4,647,814 | 3/1987 | Dobrusskin et al. | 313/641 |
| 4,978,884 | 12/1990 | Van Vliet et al. | 313/641 X |

FOREIGN PATENT DOCUMENTS

| | | | |
|---|---|---|---|
| 0342762 | 11/1989 | European Pat. Off. . | |
| 2114804 | 10/1972 | Fed. Rep. of Germany . | |
| 3829156 | 3/1989 | Fed. Rep. of Germany . | |
| 138447 | 6/1986 | Japan | 313/641 |
| 1376509 | 12/1974 | United Kingdom . | |
| 1598269 | 9/1981 | United Kingdom . | |

*Primary Examiner*—Palmer C. DeMeo

*Attorney, Agent, or Firm*—Frishauf, Holtz, Goodman & Woodward

[57] ABSTRACT

To maintain a predetermined design color temperature throughout the lifetime of a metal halide high-pressure discharge lamp, particularly suitable for illumination of theaters, film or television studios, the discharge vessel of the high-pressure lamp, typically made of quartz glass, contains a fill which, besides mercury, has a noble gas, cesium and dysprosium halide and a nickel halide. Optionally, gadolinium halide may be used. Per cubic centimeter of volume of the discharge vessel, 0.03 to 3 mg dysprosium, 0.002 to 0.5 mg nickel, and, optionally, 0.002 to 0.1 mg gadolinium are suitable. Suitable halogens for the halides are iodine and bromium, preferably in a mol relationship between 0.2 and 1.5. The metals, nickel and gadolinium limit the color temperature drop-off over the average lifetime of the lamp to at the most 1 K per operating hour of the lamp.

10 Claims, 3 Drawing Sheets

HIGH-PRESSURE METAL HALIDE DISCHARGE LAMP WITH A FILL CONTAINING NICKEL HALIDE

FIELD OF THE INVENTION

The present invention relates to high-pressure discharge lamps, and more particularly to high-pressure discharge lamps which include a metal halide fill, and in which the fill is specifically constituted to provide light which has a spectral composition approximating daylight, and which maintains the spectral composition throughout the life of the lamp without degradation.

BACKGROUND

Metal halide high-pressure discharge lamps are used, among other applications, as light sources for theaters, and for film and television studios. The light should have a color temperature which is as close to daylight as possible. Additionally, the lamps should provide this light of essentially daylight color temperature throughout the lifetime of the lamp, and without degradation as the lamp is being used. This is important since frequently a plurality of lamps are used to illuminate a scene in a theater, film or television studio or the like; when one lamp burns out, replacing that one with a new one will change the mix of light, and hence the color rendition of the scene. If a continuous production is in progress of being recorded, changing one lightbulb may change the color rendition of the scene which is being recorded. This is annoying to the viewers.

The referenced Kül et al Pat. No. 3,654,506, the disclosure of which is hereby incorporated by reference, as well as British Patent 1,376,509, describe mercury vapor high-pressure discharge lamps which have halogen additives, particularly dysprosium and/or holmium and/or thulium halides. These lamps provide light with a spectral composition approximating daylight, and a light color of about 6000 K. These lamps work very well and have found substantial acceptance; like many lamps of this type which are on the market, however, they experience a drop in color temperature of 2 K. and more per operating hour. Thus, the lamps are suitable only over a comparatively short operating time with respect to the required color temperatures. After some time, the color temperature has dropped to such an extent that it can no longer be used to record scenes on film or for television.

THE INVENTION

It is an object to provide a metal halide high-pressure discharge lamp which has a fill such that the radiation emitted from the lamp will have a color temperature of between 5200 K. to 6400 K. and in which the drop-off of color temperature over the average lifetime of the lamp is substantially reduced with respect to prior art lamps.

Briefly, the lamp has a discharge vessel with well-known electrodes and a fill including mercury, at least one noble gas, a halogen, and cesium, and dysprosium. To obtain an approximately daylight color temperature between 5600 K. to 6000 K., and to reduce drop-off of color temperature to, at the most, 1 K. per operating hour, over the entire average lifetime of the lamp, nickel is additionally added to the fill. In operation, the metals will form halides.

The halogen used, preferably, is iodine or bromine. To obtain an optimally operating halogen cycle, the mol relationship of iodine to bromine is preferably between 0.2 and 1.5. Optimal results are obtained when the discharge vessel, per cubic centimeter of its volume, contains 0.03 to 3 mg dysprosium, 0.002 to 0.5 mg nickel and, optionally, 0.002 to 0.1 mg gadolinium.

The addition of nickel to the dysprosium of the halide fill provides for a daylight color temperature. Depending on the geometry of the lamp, an increase or rise in the color temperature may be necessary with some lamps, in order to obtain the optimal value of between 5600 K. and 6000 K., respectively. This is obtained by adding gadolinium. Nickel as well as gadolinium stabilize the color temperature of the lamp. Adding both metals to the fill results in limitation of the color temperature drop to at the most 1 K. per operating hour, throughout the entire average lifetime of the lamp, especially in metal halide discharge lamps which have power ratings of between 100 W to 12000 W. The fill, thus, is suitable for high-pressure discharge lamps of a wide power range. The new fill permits operating a plurality of lamps, within their average lifetime, in which both used as well as new lamps are operated next to each other without resulting in undesirable color temperature differences of the light emitted from the respective lamps.

DRAWINGS

DETAILED DESCRIPTION

Figure 1:
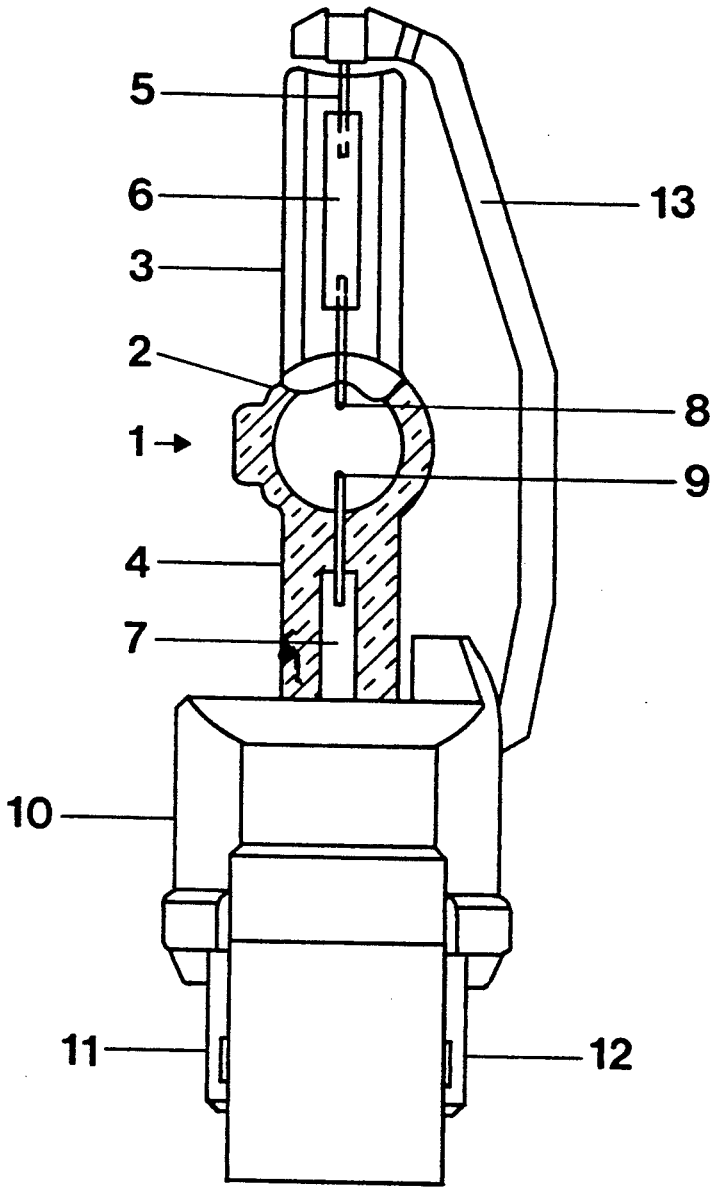
FIG. 1 is a side view, partly in section, of a low-power metal halide high-pressure discharge lamp.

Referring first to FIG. 1, which illustrates, highly schematically, a discharge lamp 1 of 130 W power rating. The discharge vessel 2 is made of quartz glass, and has two oppositely extending extensions 3, 4 which are press-sealed to retain a molybdenum sealing foil 6, 7, current supply leads 5 and pin electrodes 8, 9 extending into the discharge vessel. The electrodes are made of tungsten. A base 10 is secured to one of the extensions 4 with a suitable cement, the base 10 carrying two terminal contact elements 11, 12 for connection to contact terminals in a suitable socket. The contact terminal 11 is connected through the base 10 by a suitable connection, not visible in FIG. 1, to the sealing foil 7. The contact element 12 is connected to one end of a holding bracket 13, the other end of which is coupled to the lead 5 extending from the press seal of the extension 3 and to the sealing foil 6. The bracket 13 provides for electrical connection and, simultaneously, to hold the light source of the lamp in the position shown in FIG. 1.

A fill is included within the bulb of the discharge vessel 2, to be described hereinafter.

Figure 2:
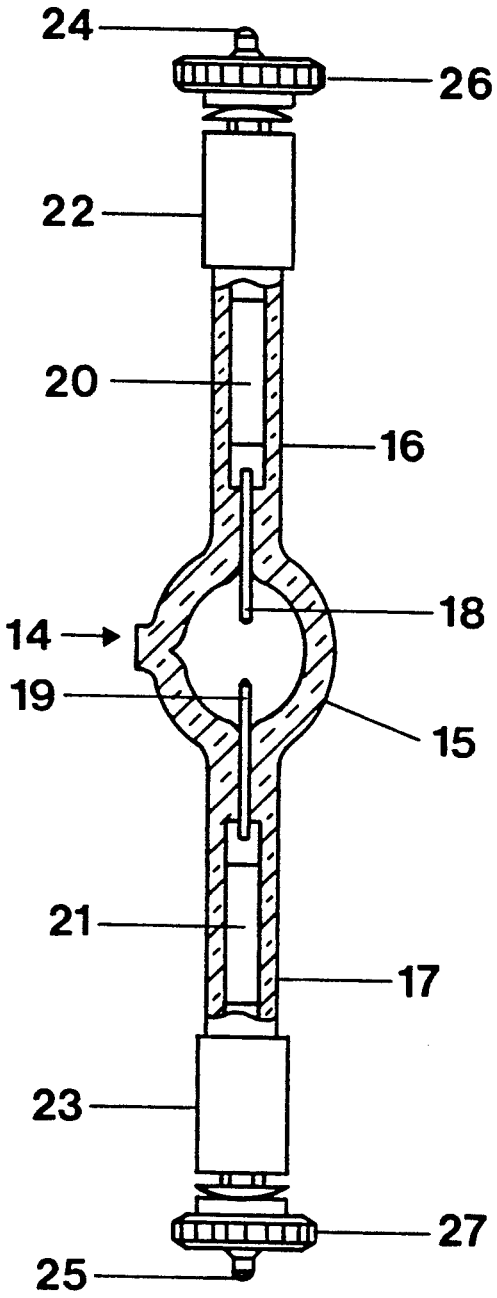
FIG. 2 is a side view, partly in section, of an intermediate power high-pressure discharge lamp.

FIG. 2 illustrates a high-pressure metal halide discharge lamp 14 having a power rating of 575 W, and having its terminal connections at respectively opposite ends of the discharge vessel 15. Discharge vessel 15, again, is of quartz glass, has essentially spherical shape, and is extended at opposite sides by projecting neck or end portions 16, 17. The extending neck or end portions 16, 17 have, respectively, pin electrodes (18, 19) of tungsten melt sealed therein, which in turn are connected via molybdenum sealing foils 20, 21 to base connections. The sealing foil 21 is electrically coupled to a base of the type SFc 10-4, which includes a base sleeve 23, fitted on the neck extension 17. A threaded pin 25 is welded to the sleeve 23. Similarly, a sleeve 22 is fitted on neck 16, and a threaded pin 24 is welded thereto, electrically connected to the molybdenum foil 20. Knurled nuts 26, 27 are screwed on the pins 24, 25, to provide electrical connections to suitable cables, clamped between the end portions of the sleeves 22, 23 and the nuts 26, 27. The bulb 15 retains a fill to be described below.

Figure 3:
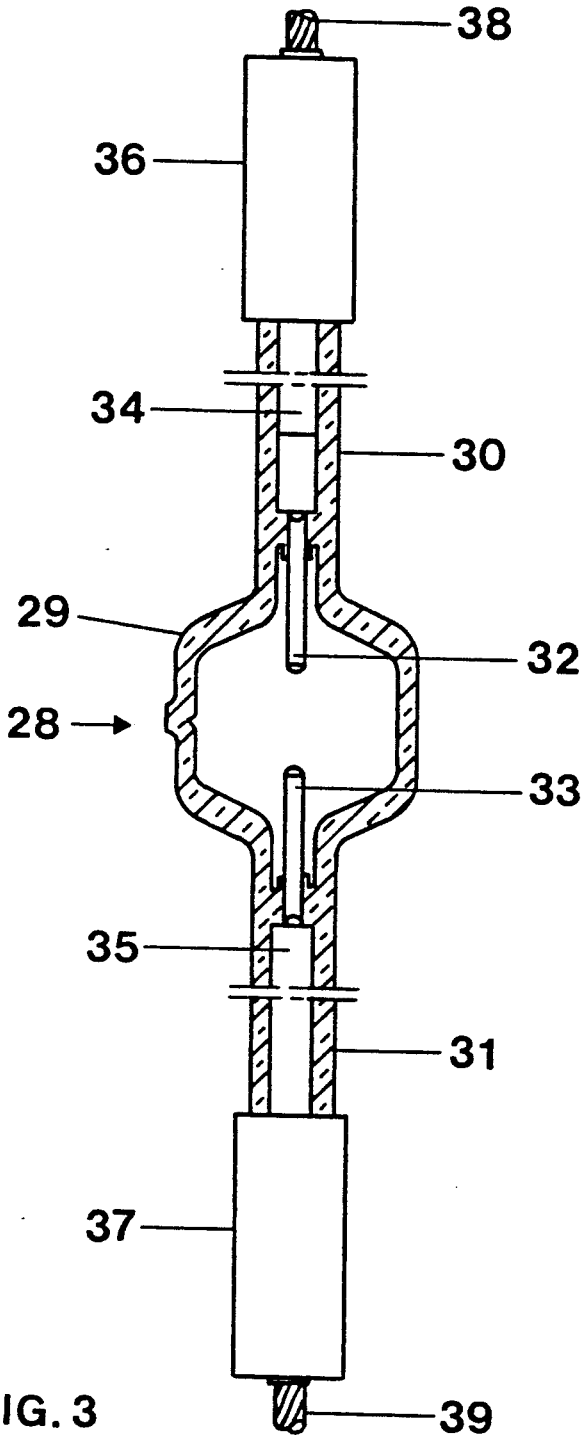
FIG. 3 is a side view, partly in section, of a high-power metal halide high-pressure discharge lamp.

FIG. 3 illustrates a double-based metal halide high-pressure discharge lamp 28 having a power rating of 12000 W. The discharge vessel 29, of quartz glass, has two neck extensions 30, 31, projecting from opposite ends of the quartz bulb 29. Two rod electrodes 32, 33 of tungsten extend into the bulb 29, vacuum-tightly sealed in the neck extensions 30, 31. They are connected to molybdenum foils 34, 35 which, in turn, are connected to the sleeves 36, 37 of the base connections of type K 25s. The bases are formed with connecting cables 38, 39 for connection to a power supply source or, respectively, to a ballast or starting or other auxiliary accessory apparatus. A fill, as will appear below, is retained within the discharge vessel 29.

The fill for the respective discharge lamps is shown in the table forming part of this application.

Various changes and modifications may be made within the scope of the inventive concept.

TABLE

| Metal halide high-pressure discharge lamp according to FIGS. 1, 2 and 3 | FIG. 1 | FIG. 2 | FIG. 3 |
|---|---|---|---|
| power rating | 130 W | 575 W | 12000 W |
| volume of discharge vessel | 0.2 $cm^3$ | 1.7 $cm^3$ | 118 $cm^3$ |
| length of arc | 4 mm | 7 mm | 25 mm |
| approximate color temperature | 5600 K | 5600 K | 6000 K |
| light output | 65 lm/W | 85 lm/W | 92 lm/W |
| color rendering index Ra | >90 | >90 | >90 |
| Fill components | | | |
| iodine ($I_2$) | 0.4 mg | 0.6 mg | 9.7 mg |
| bromine ($Br_2$) | 0.6 mg | 0.45 mg | 18.4 mg |
| cesium | 0.3 mg | 0.2 mg | 4.7 mg |
| dysprosium | 0.4 mg | 0.3 mg | 5.5 mg |
| gadolinium | — | 0.09 mg | 0.3 mg |
| nickel | 0.05 mg | 0.05 mg | 0.3 mg |
| mercury | 5.8 mg | 35.0 mg | 1133.0 mg |
| argon | 400 mbar | 400 mbar | 400 mbar |
| mol relationship iodine/bromine | 0.45 | 0.79 | 0.33 |

What is claimed is:

1. A metal halide high-pressure discharge lamp (1, 14, 28) having a discharge vessel (2, 15, 29) of high temperature resistant, light-transmissive material;

two electrodes (8, 9; 18, 19; 32, 33) within said discharge vessel, of high temperature resistant material;

a fill including at least one noble gas and a halogen within said discharge vessel; and means for generating, in operation of the lamp, light having a daylight color temperature of between about 5600 K. to 6000 K., with a drop-off or reduction in color temperature of at the most 1 K. per operating hour of the lamp over the entire average lifetime of the lamp, wherein said means is characterized in that said fill consists essentially of said at least one noble gas and said halogen, mercury, cesium, dysprosium and nickel; and wherein the dysprosium is present in the fill of the vessel in a quantity of from 0.03 mg to 3 mg per cubic centimeter of the volume of the discharge vessel.

2. The lamp of claim 1, wherein the nickel is present in the fill of the vessel in a quantity of from 0.002 mg to 0.5 mg per cubic centimeter of the volume of the discharge vessel.

3. The lamp of claim 1, wherein the halogen comprises iodine and bromine, in a mol relationship of between 0.2 and 1.5.

4. The lamp of claim 3, wherein the nickel is present in the fill of the vessel in a quantity of from 0.002 mg to 0.5 mg per cubic centimeter of the volume of the discharge vessel.

5. The lamp of claim 1, wherein the nickel is present in the fill of the vessel in a quantity of from 0.002 mg to 0.5 mg per cubic centimeter of the volume of the discharge vessel.

6. The lamp of claim 5, wherein the halogen comprises iodine and bromine, in a mol relationship of between 0.2 and 1.5.

7. A metal halide high-pressure discharge lamp (1, 14, 28) having a discharge vessel (2, 15, 29) of high temperature resistant, light-transmissive material;

two electrode (8, 9; 18, 19; 32, 33) within said discharge vessel, of high temperature resistant material;

a fill including at least one noble gas and a halogen within said discharge vessel; and means for generating, in operation of the lamp, light having a daylight color temperature of between about 5600 K. to 6000 K., with a drop-off or reduction in color temperature of at the most 1 K. per operating hour of the lamp over the entire average lifetime of the lamp, wherein said means is characterized in that said fill consists essentially of said at least one noble gas and said halogen, mercury, cesium, dysprosium, nickel and gadolinium; and wherein the gadolinium is present in the fill of the vessel in a quantity of from 0.002 mg to 0.1 mg per cubic centimeter of the volume of the discharge vessel.

8. The lamp of claim 7, wherein the dyprosium is present in the fill of the vessel in a quantity of from 0.03 mg to 3 mg per cubic centimeter of the volume of the discharge vessel.

9. The lamp of claim 7, wherein the nickel is present in the fill of the vessel in a quantity of from 0.002 mg to 0.5 mg per cubic centimeter of the volume of the discharge vessel.

10. The lamp of claim 7, wherein the halogen comprises iodine and bromine, in a mol relationship of between 0.2 and 1.5.

* * * * *